US007115018B1

(12) United States Patent
Syverson

(10) Patent No.: US 7,115,018 B1
(45) Date of Patent: Oct. 3, 2006

(54) HAND HELD ELECTRIC POLISHER

(75) Inventor: Charles D. Syverson, North Mankato, MN (US)

(73) Assignee: Innovative Polishing Systems, Inc., Stuart, FL (US)

( * ) Notice: Subject to any disclaimer, the term of this patent is extended or adjusted under 35 U.S.C. 154(b) by 0 days.

(21) Appl. No.: 11/103,018

(22) Filed: Apr. 11, 2005

(51) Int. Cl.
*B24B 23/00* (2006.01)
*B24B 49/12* (2006.01)

(52) U.S. Cl. ..... 451/6; 451/359

(58) Field of Classification Search ..... 451/6, 451/359, 344, 357, 450, 488, 41, 59, 53
See application file for complete search history.

(56) References Cited

U.S. PATENT DOCUMENTS 1,679,323 A * 7/1928 Mortlock ..... 15/29
3,104,783 A * 9/1963 Hall ..... 222/191
3,110,993 A * 11/1963 Grage ..... 451/450
3,585,427 A * 6/1971 Paule ..... 310/50
3,701,223 A * 10/1972 Cole et al. ..... 451/439
RE29,516 E 1/1978 Genaro
4,193,226 A 3/1980 Gill, Jr. et al.
4,292,571 A 9/1981 Cuneo
4,487,270 A 12/1984 Huber
4,512,107 A 4/1985 Jones
4,540,318 A 9/1985 Hornung et al.
4,561,214 A 12/1985 Inoue
4,650,375 A 3/1987 Millsap
5,357,179 A 10/1994 Abbagnaro et al.
5,423,102 A * 6/1995 Madison ..... 15/22.2
5,651,727 A * 7/1997 Weinstein et al. ..... 451/344
5,697,832 A 12/1997 Greenlaw et al.
5,964,645 A 10/1999 Jemt
6,183,343 B1 2/2001 Buzzetti
6,290,587 B1 9/2001 McCracken et al.
6,290,781 B1 9/2001 Brouillet, Jr.
6,313,597 B1 11/2001 Elliott et al.
2005/0170758 A1* 8/2005 Boyle ..... 451/41

OTHER PUBLICATIONS

"Brushless DC Motors employ ring type neodymium magnets" ThomasNet® IndustrialNewsRoom, web page printout http://www.industrialnewsroom.com/fullstory/9684.
"BN 12, 23 and 34 High Speed" Silencer™ Series Brushless DC Motors, Moog Components Group, web page printout http://www.polysci.com/docs/bnhsseries.pdf Aug. 5, 2004, 1 page.

* cited by examiner

*Primary Examiner*—Robert A. Rose
(74) *Attorney, Agent, or Firm*—Stiennon & Stiennon

(57) ABSTRACT

A polisher has a polishing disc on a shaft driven by a brushless DC motor driven by a motor controller mounted spaced from the polisher and adjacent a ground fault interrupt circuit and a power plug. Power and control wires form a cord that provides communication between a speed control switch, and a speed set switch, mounted on a handle of a polisher housing, which is a magnetic field sensor responsive to a movable magnet. The speed set switch sends a signal to the motor controller either to maintain the current speed of the motor or to allow the speed of the motor to vary in accordance with the output of of the speed control switch. The speed control switch is a variable output switch which can be an optical potentiometer constructed by reflecting light from a light source off a reflective surface forming part of a spring loaded trigger.

20 Claims, 2 Drawing Sheets

2/2

HAND HELD ELECTRIC POLISHER

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to handheld polishing tools in general, and particularly to tools suitable for polishing glass and plastic.

Glass and plastic windows are essential for all vehicles which are driven or occupied by humans where it is desirable to both be protected within the vehicle and yet be able to observe the environment surrounding the vehicle. Whether visibility is necessary for navigation, safety, reconnaissance, or enjoyment, it is important that the windows formed of glass and plastic be as free of scratches as possible so as not to obscure the vision through the window. However, by their very nature, vehicles such as planes, automobiles, trains, or boats move through the air, and are thus often abraded by particles entrained in the air. Furthermore, windshield wipers can entrap abrasive particles which are then rubbed against the surface of the window, producing scratches. In addition, the chemical activity of rain, cleaning fluids, sea water, or other fluids can chemically etch glass or plastic thereby reducing its transparency. Replacing vehicle windows which have impaired transparency is often not cost-effective.

To extend the life of vehicle windows, techniques have been developed to remove surface imperfections such as scratches, crazing, and chemical etching, by polishing the window surface to remove the optical imperfections, and creating a smooth polished surface. Variable speed drills and polishers exist which can be used with flexible polishing disks which may have polishing surfaces, or which may use polishing compounds which are placed between the polishing disks and the window surface. The polishing process can require a number of steps depending on the depth of the optical imperfections to be removed. It can also be important to control the speed of the polishing disk to control the polishing action, and at the same time to avoid overheating of the window surface. Overheating may result in the formation of particles clumping which can result in scratches, or overheating may cause damage to the window material itself. What is needed is a durable polisher which can operate at high speeds, which can maintain set speeds, and which is lightweight and easy to control.

SUMMARY OF THE INVENTION

The handheld electric polisher of this invention has a housing, and a polishing shaft supported on bearings on the housing. The housing has a handle extending at approximately right angles to a polishing shaft and integrally formed with the housing. The polisher is driven by a brushless DC motor which has a rotor of permanent magnets mounted to a motor shaft. The motor shaft is mounted to the housing by bearings. The motor shaft terminates in a helical gear which forms a helical pinion gear with a helical wheel gear mounted to the polishing shaft. The gearing ratio between the pinion and the wheel is approximately five, so that when the motor speed is varied between 12,500 rpm to 27,500 rpm, the speed of the polishing shaft varies between about 2,500 and 5,500 rpm.

The brushless DC motor has a steel laminated core with three or six windings which are driven by a motor controller which is mounted with a ground fault interrupt circuit at a power plug. The motor controller supplies power through three wires extending between the controller and a polisher housing so that the motor controller is spaced from the polisher housing. Four control wires run along the three power wires, to form a seven wire cable that provides a communications link to a speed control switch, and to a speed set switch mounted on the handle. The speed control switch is the variable output switch. The output of the variable switch is used to control the speed of the motor through the controller. The speed set switch sends a signal to the motor controller either to maintain the current speed of the motor or to allow the speed of the motor to vary in accordance with the output of of the speed control switch. The speed set switch is a magnetic field sensor which is mounted in the handle of the housing and actuated by a movable magnet. The speed control switch is an optical potentiometer constructed by reflecting light from a light source off a reflective surface mounted to a spring loaded trigger.

It is a feature of the present invention to provide an electric handheld polisher with increased durability.

It is another feature of the present invention to provide an electric handheld polisher of lighter weight.

It is a further feature of the present invention to provide an electric handheld polisher on which a water spray is mounted.

It is yet another feature of the present invention to provide an electric handheld polisher which separates the motor controller from the motor housing.

Further objects, features and advantages of the invention will be apparent from the following detailed description when taken in conjunction with the accompanying drawings.

DESCRIPTION OF THE PREFERRED EMBODIMENTS

Figure 1:
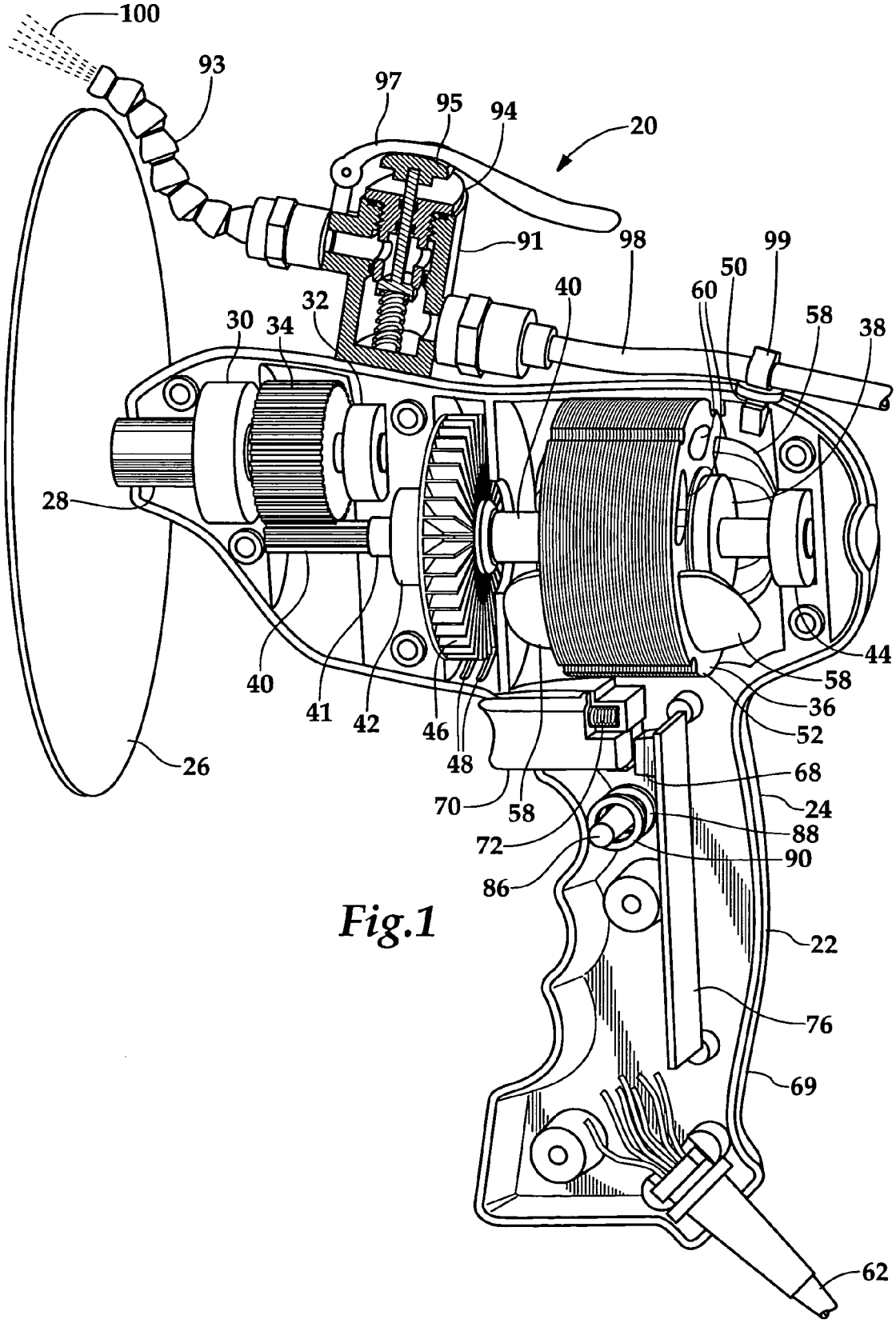
FIG. 1 is an illustrative view of the polisher of this invention, with one half of the housing removed.

Referring more particularly to FIGS. 1–4 wherein like numbers refer to similar parts, a handheld polisher 20 is shown in FIG. 1. The polisher 20 has a housing 22 comprised of a right hand portion 24 shown in FIG. 1 and a left-hand portion 25 shown in FIG. 4. A polishing disk 26 constructed of rubber or other flexible material is mounted for rotation on a shaft 28. The shaft 28 is supported on the housing 22 by a first bearing 30 and a second bearing 32 and has a forty-one tooth helical wheel gear 34 which is keyed to the shaft 28 between the first bearing 30 and the second bearing 32. The first bearing 30 is larger than the second bearing, and receives the majority of the thrust load from the polishing disk 26. The shaft 28 decreases in diameter as it enters the first bearing 30, and to a lesser extent as it enters the second bearing 32 so that thrust loads are applied principally to the first bearing but also to the second bearing.

The shaft 28 to which the polishing disk 26 is mounted is driven by a three phase brushless DC motor 36. The motor 36 has a four pole permanent magnet rotor 38 mounted to a motor shaft 41 which terminates in a seven tooth helical pinion gear 40 which drives the forty-one tooth helical gear 34. The gears 40, 34 in FIG. 1 are illustrated with straight teeth for simplicity. The motor shaft 41 is mounted to the housing 22 between a third bearings 42 and a fourth bearing 44. A radial fan 46 as well as the rotor 38 are mounted between the bearings 42, 44. The fan 46 fits within a fan housing 48 formed by portions of the housing 22 and draws air from portions 50 of the housing 22 which contain the motor 36. Air vent holes 54, shown in FIG. 4, allow air to be drawn into the housing past the motor 36, and to then be vented through openings 56 in the fan housing 48. A motor stator 52 is mounted to the housing 22. The stator 52 surrounds the rotor 38 and is mounted within the motor containing portions 50 of the housing 22.

Figure 4:
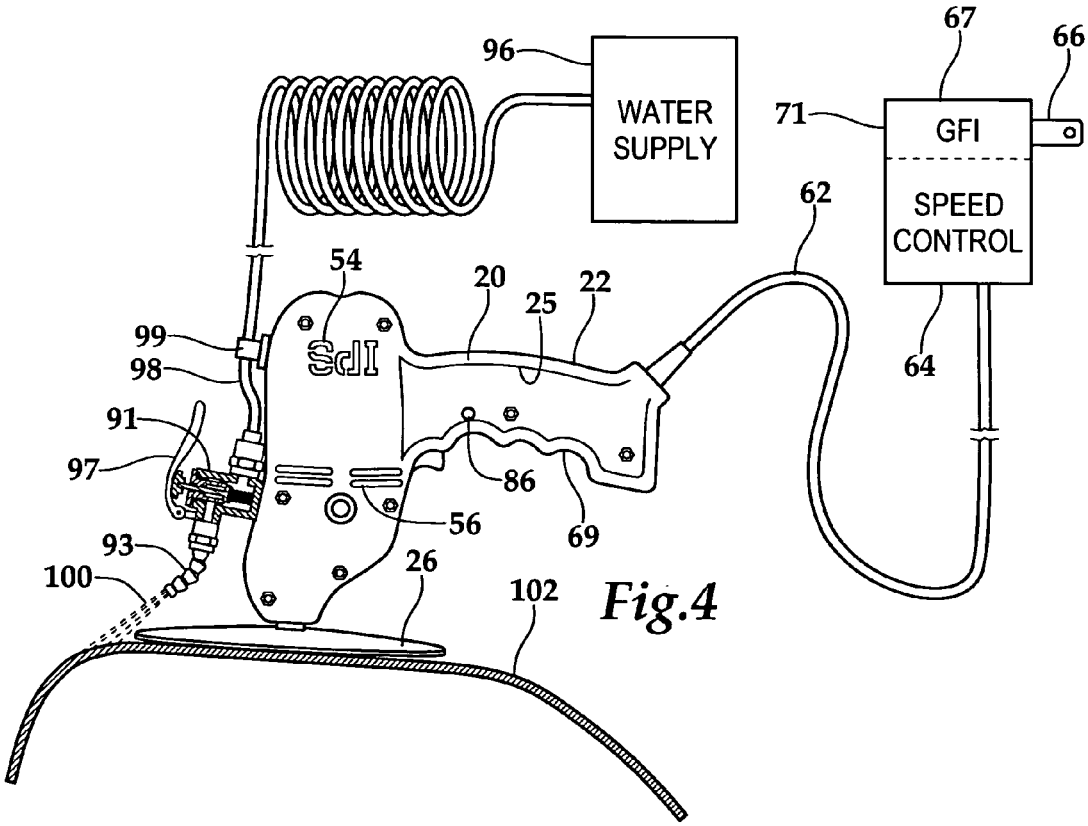
FIG. 4 is a schematic view of the polisher of FIG. 1 including a plug-mounted speed controller and a water supply.

The rotor 38 is driven by three or six electrical windings 58 which are wound within six slots 60 formed by a plurality of ferrous laminations which form the stator 52. The windings 58 are Y-connected with one or two coils from each phase on each arm or leg of the Y. If two coils are used with one half the number of turns for each single phase, the coils can be wound around opposite core posts defined by the six slots. Each leg or arm of the Y is fed with one of three phases of the power through three wires of the cord 62. The windings are suppled with full-wave rectified 120 VAC or approximately 160 VDC. A speed controller 64 is mounted a selected distance away from the polisher 20. As shown in FIG. 4, the speed controller 64 is preferably mounted at a plug 66 which terminates the power and controller cord 62. Advantageously, a ground fault interrupt circuit 67 will be incorporated into the same housing 71 as the speed controller 64. The controller 64 is a conventional motor controller which controls motor speed utilizing back EMF so that a Hall effect sensor or the like are not required on the motor stator 52. The power and controller cord 62 has three power wires and four control wires. A handle 69 extends from the housing, and is preferably formed integrally with the housing. The control wires receive input from a linear output optical sensor 68, mounted in the handle 69 and controlled by a trigger 70 which is biased by a spring 72. The control wires also receive a speed set signal from a binary magnetic sensor 74 which is used to command the speed controller to hold the current speed, as set by the position of the trigger 70 and the output of the optical sensor 68.

Figure 2:
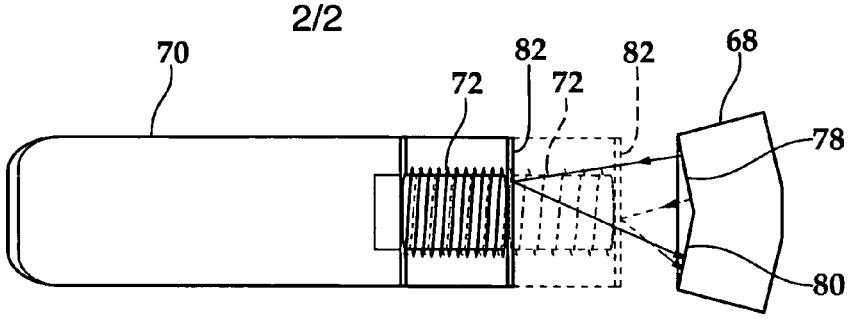
FIG. 2 is enlarged fragmentary view of the speed control trigger and sensor of the polisher of FIG. 1.

The speed control trigger 70 is biased to a first position by the spring 72 and can be depressed to a second position by compression of the spring as shown in FIG. 2.

The optical sensor 68 is mounted to a circuit board 76 and comprises a light emitting diode 78, and a photo sensor 80 arranged to receive the light reflected from a surface 82 of the trigger 70. Depressing the trigger 70 against the spring 72 moves the surface 82 closer or further from the optical sensor 68. Movement of the trigger 70 changes the spacing between the light reflecting surface 82 and sensor by approximately 1:2 which in turn controls the speed of the motor 36. The intensity of of the light received by the photo sensor 80 as reflected from the surface 82 increases as the surface 82 moves closer to the optical sensor 68. The output of the optical sensor 68 can be designed to approximate a linear response to the movement of the trigger 70, or an algorithm may be used to linearize the output of the photo sensor 80. The output of the optical sensor 68 is sent to the speed controller 64 and used to set the speed of the motor 36 in accordance with the movement of the trigger 70.

Figure 3:
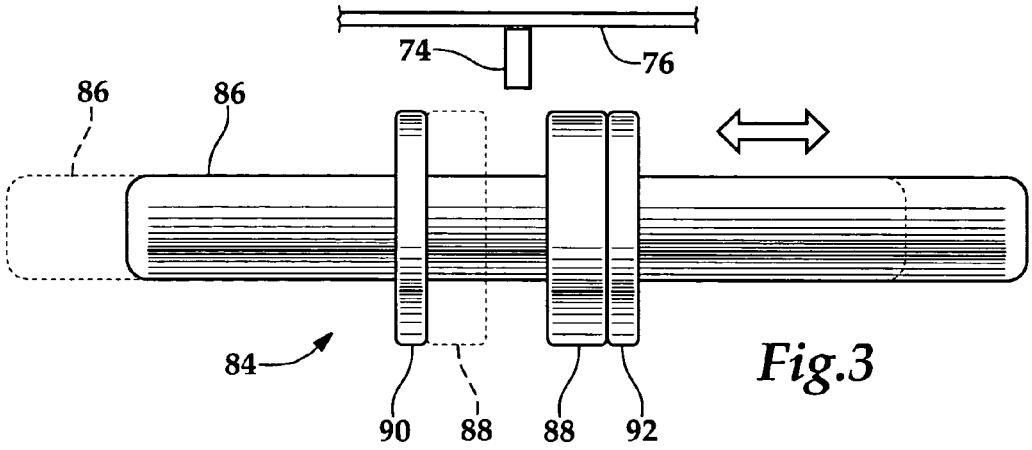
FIG. 3 is an enlarged fragmentary view of a speed set switch and magnetic sensor of the polisher of FIG. 1

When it is desired to hold the speed of the motor 36 at a selected speed determined by movement of the trigger 70, a transverse switch 84 consisting of a short shaft 86 mounted transverse to the handle 69 is used. As shown in FIG. 3, a permanent magnet 88 is mounted fixed to the short shaft 86 and positioned within the housing 22. A binary type Hall effect sensor 74 is caused to change state as the permanent magnet 88 passes by the sensor 74. Permanent washer shaped magnets 90, 92 are mounted to the housing 22 to hold the permanent magnet 88 in one of the two states illustrated in FIG. 3. Switching between illustrated states causes a change in state of the Hall effect sensor 74 which is communicated to the speed controller 64, and used by the speed controller to control locking or releasing a set speed.

The handheld polisher 20, as shown in FIG. 4, has a water spray nozzle 93 mounted to a spray housing 91 which contains a valve 94 of the push button type valve will be installed into the mounting bracket such that a button 95 protrudes out the top of the bracket and the operator only needs to push down on the button to operate the water misting action which controls a flow of water from a pressurized water supply 96 to the spray nozzle 93 by way of a supply hose 98. A optional lever 97 as shown, can be used to depress the button 95. The water supply hose 98 may be supported on the housing 22 by a clip 99. The spray housing 91 may be mounted to the polisher housing 22 in a position so that the spray nozzle 93 can spray water 100 on to a window 102 to facilitate cooling and lubricate the polishing process on the window 102. The spray nozzle 93 if construed of LOC-LINE® components can be readily adjusted to point the water spray in a desired direction.

Depending on the type of surface being polished and the particular polishing compound and/or polishing disks used, the desire to speed the polishing may vary. Through operator experience or by consulting a readout of the motor speed, the trigger is used to select and to vary the speed of the motor and thus the polishing disk 26. The gearing ratio between gears 34 and 40 functions as a reduction gear having a speed ratio of about 5:1 so that when the motor speed is varied between about 12,500 to about 27,500 rpm, the speed of the polishing shaft 28 varies between about 2,500 rpm and about 5,500 rpm. The actual maximum surface speed at which polishing takes place is dependent on the diameter of the polishing disk 26.

It is understood that the invention is not limited to the particular construction and arrangement of parts herein illustrated and described, but embraces all such modified forms thereof as come within the scope of the following claims.

I claim:

1. A handheld polishing tool comprising:

a housing having at least one handle extending therefrom;

a polishing shaft mounted for rotation on the housing;

a brushless DC motor mounted within the housing;

a gear train connecting the motor to the polishing shaft whereby the polishing shaft is driven to rotate by the motor;

a power cord, for suppling power to the motor, extending from the housing a selected distance to a power plug;

a motor speed control circuit mounted spaced from the housing along the power cord, the motor speed control circuit supplying power to the motor, and in speed controlling relation to the motor; and a switch having a variable output, the switch mounted to the handle and connected by a communications link to the motor speed control circuit and arranged to cause the motor speed control circuit to vary the speed of the motor in proportion to the variable output of the switch.

2. The handheld polishing tool of claim 1 wherein the motor speed control circuit is located at the power plug.

3. The handheld polishing tool of claim 1 further comprising a ground fault interrupt circuit located at the power plug.

4. The handheld polishing tool of claim 3 wherein the ground fault interrupt circuit and motor speed control circuit are incorporated into a single housing at the power plug.

5. The handheld polishing tool of claim 1 further comprising:

a spray nozzle mounted to the housing; and a supply hose connected to the spray nozzle, wherein the supply hose is connected to a source of pressurized water.

6. The handheld polishing tool of claim 1 farther comprising a binary switch mounted to the handle and connected by a second communication link to the speed control circuit, the switch arranged to cause the motor speed control circuit to maintain the motor speed at a selected speed, or to cause the motor speed control circuit to respond to the variable output switch.

7. The handheld polishing tool of claim 6 wherein the binary switch comprises a magnet movable with respect to a magnetic field sensor.

8. The handheld polishing tool of claim 7 wherein the magnet movable with respect to the magnetic field sensor is mounted to a shaft which extends through the handle extending from the housing, and is slidably mounted with respect to the housing so that the magnet is contained within the handle and is movable with respect to the magnetic field sensor, the magnetic field sensor being fixed with respect to the handle.

9. The handheld polishing tool of claim 8 wherein a first magnet and a second magnet are mounted within the handle and are fixed to the handle, and the movable magnet is arranged to move between said first magnet and said second magnet past the magnetic field sensor, and wherein the first magnet, the second magnet and the movable magnet have magnetic poles arranged so that the movable magnet is held against said first magnet or said second magnet when engaged with said first magnet or said second magnet by magnetic attraction.

10. The handheld polishing tool of claim 1 wherein the switch has a variable output and has an optical sensor and a reflecting surface movable with respect to the optical sensor so that the optical sensor projects light towards the reflecting surface and receives light from the reflecting surface, the received light from the reflecting surface controlling the output of the optical sensor and thus of the switch.

11. The handheld polishing tool of claim 1 wherein the motor is varied between about 12,500 rpm to about 27,500 rpm, and wherein the gear train connecting the motor to the polishing shaft has a ratio to produce in the polishing shaft a corresponding speed of between about 2,500 rpm and about 5,500 rpm.

12. A handheld polishing tool comprising:

a housing;

a polishing shaft mounted for rotation on the housing;

a motor mounted within the housing;

a gear train connecting the motor to the polishing shaft whereby the polishing shaft is driven to rotate by the motor;

a power cord extending from the housing a selected distance to a power plug;

a motor speed control circuit mounted spaced from the housing along the power cord, the motor speed control circuit supplying power to the motor, and in speed controlling relation to the motor; and a switch having a variable output, the switch being mounted to the housing and connected by a communication link to the motor speed control circuit and arranged to cause the motor speed control circuit to vary the speed of the motor in proportion to the variable output of the switch.

13. The handheld polishing tool of claim 12 wherein portions of the housing defining a handle; and wherein the switch having a variable output is mounted to the handle;

further comprising:

a binary switch mounted to the handle and connected by a second communication link to the speed control circuit, the binary switch being arranged to cause the motor speed control circuit to maintain the motor speed at a selected speed, or to cause the motor speed control circuit to respond to the variable output switch.

14. The handheld polishing tool of claim 13 wherein the binary switch comprises a magnet movable with respect to a magnetic field sensor.

15. The handheld polishing tool of claim 12 wherein the variable output switch has an optical sensor and a reflecting surface movable with respect to the optical sensor so that the optical sensor projects light towards the reflecting surface and receives light from the reflecting surface, the received light from the reflecting surface controlling the output of the optical sensor and thus of the switch.

16. A handheld polishing tool comprising:

a housing;

a polishing shaft mounted for rotation on the housing;

a motor mounted within the housing;

a gear train connecting the motor to the polishing shaft whereby the polishing shaft is driven to rotate by the motor;

a spray nozzle mounted to the housing;

a supply hose connected to the spray nozzle, wherein the supply hose is connected to a source of pressurized water;

a power cord extending from the housing a selected distance to a power plug;

a motor speed control circuit mounted to the power plug, the motor speed control circuit supplying power to the motor, and in speed controlling relation to the motor; and a switch having a variable output, the switch mounted to the housing and connected by a communication link to the motor speed control circuit and arranged to cause the motor speed control circuit to vary the speed of the motor in proportion to the variable output of the switch.

17. The handheld polishing tool of claim 16 wherein portions of the housing defining a handle; and wherein the switch having a variable output is mounted to the handle;

further comprising:

a binary switch mounted to the handle and connected by a second communication link to the speed control circuit, the binary switch being arranged to cause the motor speed control circuit to maintain the motor speed at a selected speed, or to cause the motor speed control circuit to respond to the variable output switch.

18. The handheld polishing tool of claim 16 wherein the switch having a variable output has an optical sensor and a reflecting surface movable with respect to the optical sensor so that the optical sensor projects light towards the reflecting surface and receives light from the reflecting surface, the received light from the reflecting surface controlling the output of the optical sensor and thus of the switch.

19. The handheld polishing tool of claim 16 further comprising a ground fault interrupt circuit located at the power plug.

20. The handheld polishing tool of claim 19 wherein the ground fault interrupt circuit and motor speed control circuit are incorporated into a single housing at the power plug.

* * * * *